US005406804A

United States Patent [19]

Vatavuk

[11] Patent Number: 5,406,804

[45] Date of Patent: Apr. 18, 1995

[54] REFRIGERATION DEVICE FOR CONTAINERS FOR INDUSTRIAL USE, AND REFRIGERATION PROCESS FOR CONTAINERS FOR INDUSTRIAL USE USING SUCH EQUIPMENT

[75] Inventor: Nenad Vatavuk, Sto. Andre, Brazil

[73] Assignee: Nordon Industrias Metalurgicas S/A, Sao Paulo, Brazil

[21] Appl. No.: 154,602

[22] Filed: Nov. 19, 1993

[30] Foreign Application Priority Data

Nov. 25, 1992 [BR] Brazil ..... 9204865

[51] Int. Cl.[6] ..... F25B 39/02

[52] U.S. Cl. ..... 62/519; 62/525; 62/528

[58] Field of Search ..... 62/519, 516, 518, 527, 62/528, 524, 525, 511; 165/168, 169

[56] References Cited

U.S. PATENT DOCUMENTS

| | | | |
|---|---|---|---|
| 243,759 | 7/1881 | Cook | 62/525 X |
| 1,041,317 | 10/1912 | Mattingly | 62/525 X |
| 2,159,251 | 5/1939 | Brizzolara | 62/527 |
| 2,740,378 | 4/1956 | Duncan | 62/526 X |

FOREIGN PATENT DOCUMENTS

| | | | |
|---|---|---|---|
| 929204 | 12/1947 | France | 62/527 |
| 509525 | 7/1939 | United Kingdom . | |
| 642271 | 8/1950 | United Kingdom . | |
| 707102 | 4/1954 | United Kingdom . | |
| 1100997 | 1/1968 | United Kingdom . | |

*Primary Examiner*—Harry B. Tanner
*Attorney, Agent, or Firm*—Steinberg, Raskin & Davidson

[57] ABSTRACT

A refrigeration device for refrigerating containers for industrial use, and process for the same, includes an upper collector for feeding a refrigerant liquid into an interior of the covers around the container so that the liquid falls only by the force of gravity, and a distribution system.

16 Claims, 1 Drawing Sheet

REFRIGERATION DEVICE FOR CONTAINERS FOR INDUSTRIAL USE, AND REFRIGERATION PROCESS FOR CONTAINERS FOR INDUSTRIAL USE USING SUCH EQUIPMENT

BACKGROUND OF THE INVENTION

The present invention relates to a refrigeration device for containers for industrial use with circulation/evaporation of a refrigerant liquid in a closed circuit, and a refrigeration process using this device.

The refrigeration device and process in accordance with the present invention provide several advantages in the operational cost, functionality and other aspects of a refrigeration technique when compared to prior art processes of refrigeration using a refrigerant liquid.

The basic procedure used in the prior art is to achieve refrigeration in containers for industrial use, e.g., tanks containing the product to be refrigerated, by pumping refrigerant liquids, e.g., ammonia, R12, R22, R502, to refrigeration covers, or refrigeration jackets, at an excessive pumping level and in a direction from the bottom of the cover to the top of the cover. However, the refrigerant liquid goes into the lower part of the cover and comes out through the upper part in the form of a vapor that is more liquid, i.e., moist. For each pressure applied in the cover, there is a corresponding temperature of the refrigerant liquid. This pressure is regulated by thermostatic valves, constant pressure or by both in combination.

When the refrigerant liquid proceeds upward along the cover under pressure, the liquid performs a heat exchange process with the product to be refrigerated so that evaporation occurs. Since the refrigerant liquid is typically pumped in excess, and possibly even continuously, into the container, there is refrigerant liquid and vapor from the refrigerant liquid inside the covers. The liquid will have bubbles that tend to form and go up along the walls of the container. It is a significant disadvantage that these bubbles agglutinate and, thus, isolate the walls of the refrigerant liquid causing a low efficiency in the heat exchange process.

Another disadvantage in this conventional prior art process is that with the covers flooded, the volume of refrigerant liquid present in the system is too high. This also causes significant problems since the heating of the refrigerant liquid generates high internal pressures in the covers due to the expansion of the liquid during the heating process. There is also a significant operational cost to keep a large volume of refrigerant liquid circulating in the refrigeration system.

Another disadvantage of this conventional prior art refrigeration process is the risk to the environment and to the operators involved in the steps of the process, since the process involves high pressures, large volumes of refrigerant liquid, and a significant degree of toxicity of the materials in the process.

In addition to these afore-mentioned disadvantages, the conventional process using excessive pumping of a refrigerant liquid presents certain cycles of work when a refrigerant liquid is not acceptable. In this case, the system is drained, which complicates the installation and operation of the covers.

When the covers have a relatively high height, e.g., large tanks, there are different operating temperatures at each height of the liquid column, resulting from the direct action of the static pressure of the column of the refrigerant liquid which increases the evaporation pressure of the system. In these cases, the covers are divided into sectors of predetermined heights which makes the cost of the installation extremely expensive since there are more covers, more tubes, more auxiliary equipment for the operational control and maintenance. The system for circulation of the refrigerant liquid becomes more complicated.

This division of the covers into distinct sectors is also applied in certain procedures when necessary to refrigerate just one particular zone, i.e., a first zone, and afterwards complementary zones. In this manner, during the filling with the product to refrigerated, just the lower tank zone is initially refrigerated. Thereafter, as the tank is subsequently filled, the immediate zones become refrigerated. It is apparent though, that the disadvantages mentioned above occur in this procedure as well.

OBJECTS AND SUMMARY OF THE INVENTION

It is therefore an object of the present invention to provide a new and improved refrigeration device and method for industrial use which substantially eliminate the problems described above.

It is another object of the present invention to provide a new and improved refrigeration device in which independent zones corresponding to, e.g., separate compartments containing items to be cooled in the refrigeration device, are cooled thereby avoiding the necessity of cooling the entire refrigeration device for only particular compartmentalized portions.

The device in accordance with the present invention comprises a main distributing tubulation having a plurality of tubes, or channels, that are oriented in a vertical direction and in which a fluid flows in a downward direction. The tubes are placed next to an external side of the container walls. The tubes have an oblong section and are linked on their upper and lower parts by respective upper and lower collectors, or headers. Horizontal tubes in the main distributing tubulation run through an interior of the upper collector and distribute the refrigerant liquid to the vertical tubes. The upper collector tubes are connected to a feeding tube which feeds the refrigerant liquid into the upper collector. The liquid then falls through the vertical tubes due to gravitational forces, i.e., by the effect of gravity. Other forces or means may be applied to direct the liquid through the tubes in the downward direction.

At least one secondary distributing tubulation is arranged inside the vertical tubes and comprises thin vertical tubes. The thin vertical tubes of the secondary tubulation have a length less than the length of the vertical tubes of the main tubulation. An exit connection is arranged in the lower collector for removing refrigerant liquid and vapor.

In preferred embodiments, a thermal isolating element is arranged to cover the vertical tubes on the external wall of the container. The refrigerant liquid flows in a downward direction through the vertical tubes and the thin vertical tubes arranged therein. The vertical tubes of the main distributing tubulation have a uniform length and a oblong cross-sectional shape. Individual ones of the thin vertical tubes of the secondary tubulation are placed inside individual ones of the vertical tubes of the main tubulation. Regulation means, e.g., valves are arranged between the feeding line and the main tubulation and the secondary tubulation for regulating the amount of refrigerant liquid passing to the main tubulation and the secondary tubulation.

In the embodiment wherein the container is subdivided into separately cooled refrigeration zones, the device includes one secondary tubulation having a different set of pipes of a given length for each separate zone.

In the refrigeration process for cooling items in a container, in accordance with the invention, at least two refrigeration zones can be independently cooled. Refrigerant liquid is pumped to a main distributing tubulation and/or a secondary distributing tubulation. Thereafter, the liquid falls from the main distributing tubulation through a first set of vertical pipes extending the length of a first refrigeration zone and/or from the secondary distributing tubulation through a second set of vertical pipes extending the length of a second refrigeration zone. The second set of pipes is arranged in an interior of the first set of pipes. The second set of pipes have a length less than the length of the first set of pipes.

A lower collector for liquid is connected at a lower end of the first set of pipes and an upper collector for liquid is connected at an upper end of the first set of pipes. The second set of pipes extend downward from the secondary distributing tubulation a distance between the lower collector and the upper collector. The first set of pipes is arranged along an external wall of the container to thereby cool the items in the container. An exit connection in the lower collector removes excess refrigerant liquid and vaporized refrigerant liquid.

In a preferred embodiment, refrigerant liquid is pumped into the main distributing tubulation and the secondary distributing tubulation through a feeding tube and the amount of refrigerant liquid flowing into the main distributing tubulation and the secondary distributing tubulation is regulated and controlled, e.g., by valves.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
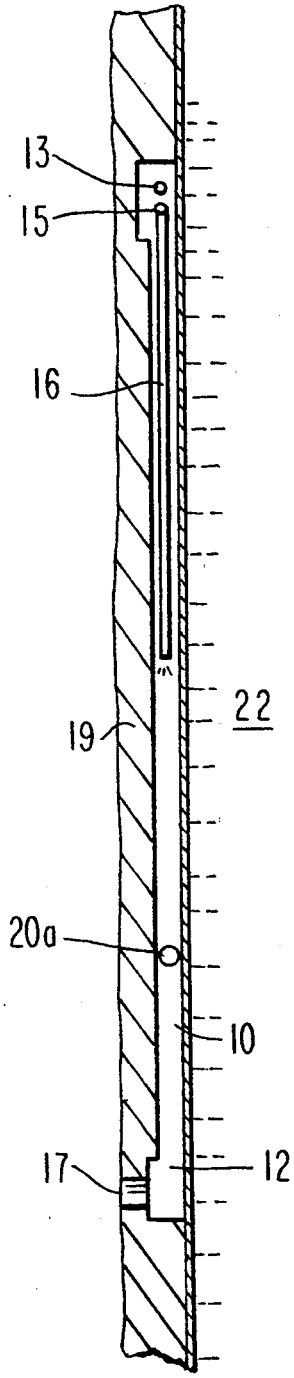
FIG. 1 represents a partial longitudinal view in one section of a container for industrial use in accordance with the present invention, containing the product to be refrigerated.
Figure 2:
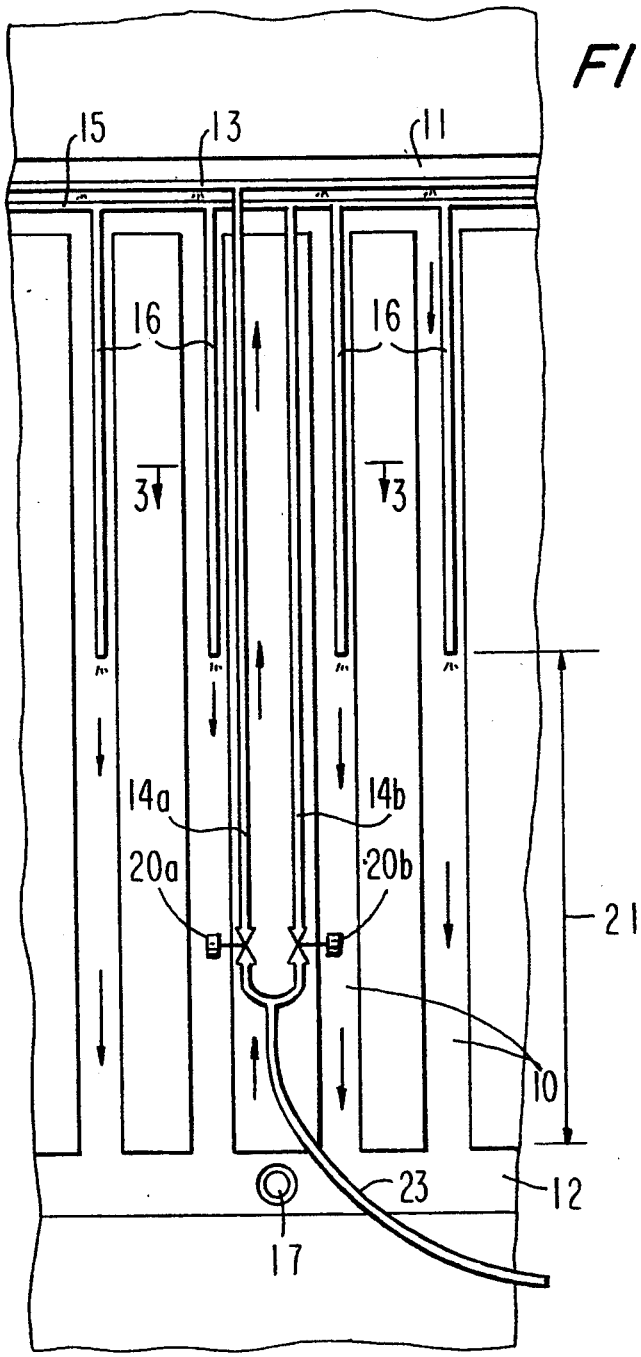
FIG. 2 represents a partial frontal and schematic view of a section of the device illustrated in FIG. 1.
Figure 3:
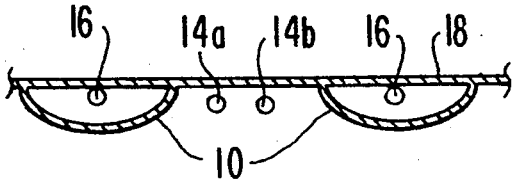
FIG. 3 represents a sectional view taken along the line 3—3 of FIG. 2.

The refrigeration device for containers for industrial use in accordance with the present invention comprises a plurality of vertical tubes or channels 10 in which a fluid flows in a downward direction. The tubes 10 preferably have an oblong section, and are connected at respective ends to an upper collector or upper header 11 and a lower collector or lower header 12. Inside the upper collector, a main tubulation system is arranged. The main tubulation system has a distributing purpose 13, also referred to as the main distributing tubulation, for feeding refrigerant liquid to the tubes 10 and at least one secondary distributing tubulation 15. The secondary distributing tubulation 15 contains thin vertical tubes 16 placed inside of vertical tubes 10 in which the fluid flows downward to an exit connection 17 arranged in the lower collector 12. The length of the thin vertical tubes 16 is less than the length of the vertical tubes 10. In addition, to the exit connection 17, the lower collector 12 also contains refrigerant liquid and vapor. All of this structure is installed in connection with the outside part of the lateral wall of the container 18 and is covered by a thermal isolation element 19. The vertical tubes 10 are preferably uniform in length and cross-section in the refrigeration device, however, different size and shape tubes can be used if desired.

The refrigeration process in accordance with the invention using the device described above comprises the steps of pumping of the refrigerant liquid from a source thereof (not shown) through a connector member 23 to a valve **20*a* leading to the feeding tube 14*a* up to a part of the main distributing tubulation 13 in the upper collector. The refrigerant liquid descends from the main distributing tubulation 13 due to the effect of gravity through the vertical tubes 10**. In this manner, it is possible to cool the entire refrigeration device.

Alternatively, it is possible to provide a cooling function via the refrigerant liquid to only an upper part 21 of the device. In this manner, the refrigerant liquid is directed from a source thereof (e.g., the same source from which refrigerant liquid is directed to valve **20*a*) through the connector member 23 to a second valve 20*b* and into a feeding tube 14*b* and from there, into the secondary distributing tubulation 15 where it drops due to the effect of gravity through the thin vertical tubes 16 located in the interior of the vertical tubes 10. The thin vertical tubes 16 descend from the upper part 21 to a height level between the lower collector 12 and the upper collector 11**.

In both operating situations, the lateral wall of the container 18 becomes wet via the refrigerant liquid and exchanges heat with a product 22 contained with the container 18. Moreover, in this manner, a part of the refrigerant liquid evaporates and moves into the lower collector 12 where the refrigerant liquid that has been pumped in excess is also present. Any fluid, e.g., excess fluid or evaporated fluid, come out from the refrigeration device through the exit connection 17.

The advantages inherent to the combined use of the device and process described above include the fact that by controlling the pressure in the cover, it is possible to obtain a constant and uniform temperature in the device since a liquid column which causes different pressures and temperatures is not present in this device. Further, the achievement of a constant temperature and pressure is aided by the fact that the liquid falls solely and exclusively by the effect of gravity.

Another important advantage is that the heat exchange of the refrigeration device and method in accordance with the present invention is more efficient than that in the prior art since the refrigerated surface where there is such an exchange is permanently wet.

It is another advantage that any vapors that come from the refrigerant surface go into the vertical tube 10 and flow down towards the exit connection 17 so that the refrigerant liquid is constantly renewed and replenished in the cooled wall. This eliminates the problem of the refrigerant liquid and vapor from the refrigerant liquid accumulating inside the vertical tubes and forming bubbles which agglutinate and isolate the walls of the refrigerant liquid causing a low efficiency in the heat exchange process.

The content of the refrigerant liquid presence in the cover is extremely reduced in relation to the typical procedures in prior art devices in which the refrigerant liquid drops and vaporizes only.

Practical tests already performed regarding the present invention indicate that it is possible to drastically reduce the amount of refrigerant liquid so that the present invention uses an amount only 1/20th of the amount used in the conventional refrigeration process. This noticeable reduction represents a significant impact on the effect to the environment and to the operators by a refrigeration process as well as lower costs. In addition, in the case of overheating of the storage area, there is no danger resulting from the expansion of the refrigerant liquid as occurs when the refrigerant liquid is, e.g., liquid ammonia.

In the embodiment wherein the container is subdivided into upper and lower zones or into intermediate zones, it is sufficient to use the mechanisms represented by the secondary tubulations 15, i.e., the tubes having small diameter, descending to a desired height level to provide refrigeration for the zone. For each defined zone, there will be a secondary distributing tubulation 15 and its respective thin vertical tube 16 whose operation will be controlled by valves 20*a* and 20*b*. The control of the pressure and temperature will remain unchanged when this operational alternative is used.

It is understood that any number of secondary distributing tubulations can be arranged in the refrigeration device depending on the amount of different refrigeration zones in the container. Each secondary tubulation will have vertical pipes of a different length and which are placed in the vertical pipes of the main distributing tubulation.

The examples provided above are not meant to be exclusive. Many other variations of the present invention would be obvious to those skilled in the art, and are contemplated to be within the scope of the appended claims.

I claim:

1. A refrigeration device for industrial use, comprising a container containing items to be refrigerated, a plurality of vertical channels arranged on an external wall of said container, an upper header connected to and arranged at an upper end of said plurality of vertical channels, a lower header connected to and arranged at a lower end of said plurality of vertical channels, a main distributing tubulation arranged in said upper header, at least one secondary distributing tubulation comprising thin vertical tubes arranged inside said plurality of vertical channels, said thin vertical tubes having a length less than the length of said plurality of vertical channels, first feeding means for feeding refrigerant liquid to said main tubulation, second feeding means for feeding refrigerant liquid to said at least one secondary tubulation, and an exit connection arranged in said lower header for removing refrigerant liquid and vapor.

2. The device of claim 1, further comprising a thermal isolating element arranged to cover said plurality of vertical channels on said external wall of said container.

3. The device of claim 1, wherein the refrigerant liquid flows in a downward direction through said plurality of vertical channels and said thin vertical tubes arranged therein.

4. The device of claim 1, wherein said plurality of vertical channels have a uniform length and a oblong cross-sectional shape.

5. The device of claim 1, wherein individual ones of said thin vertical tubes are placed in individual ones of said plurality of vertical channels.

6. The device of claim 1, further comprising a feeding line leading from a source of refrigerant liquid, said first feeding means comprise a first valve arranged between said feeding line and said main tubulation and said second feeding means comprising a second valve arranged between said feeding line and said at least one secondary tubulation, said first and second valves regulating the amount of refrigerant liquid passing to said main tubulation and said at least one secondary tubulation, respectively.

7. The device of claim 1, further comprising regulation means for regulating the flow of refrigerant liquid to said main tubulation and said at least one secondary tubulation.

8. The device of claim 1, wherein the container is subdivided into refrigeration zones, one of said secondary tubulations corresponding to each of said zones such that a set of said thin vertical tubes extends the length of a respective one of said zones in said plurality of vertical channels.

9. A refrigeration process for cooling items in a container, comprising pumping refrigerant liquid to a main distributing tubulation and/or a secondary distributing tubulation, directing the liquid to fall from the main distributing tubulation through a first set of vertical pipes extending the length of a first refrigeration zone and/or directing the liquid to fall from the secondary distributing tubulation through a second set of vertical pipes extending the length of a second refrigeration zone, and arranging the second set of pipes in an interior of the first set of pipes, the second set of pipes having a length less than the length of the first set of pipes.

10. The process of claim 9, further comprising connecting a lower header at a lower end of the first set of pipes and connecting an upper header at an upper end of the first set of pipes, the second set of pipes extending downward from the secondary distributing tubulation a distance between the lower header and the upper header.

11. The process of claim 9, further comprising arranging the first set of pipes along an external wall of the container.

12. The process of claim 9, further comprising connecting an exit connection in the lower header to remove excess refrigerant liquid and vaporized refrigerant liquid.

13. The process of claim 9, further comprising pumping refrigerant liquid into the main distributing tubulation and the secondary distributing tubulation through a feeding tube.

14. The process of claim 9, further comprising regulating and controlling the amount of refrigerant liquid flowing into the main distributing tubulation and the secondary distributing tubulation.

15. A refrigeration process for refrigerating items in a container, comprising the steps of:

arranging a plurality of vertical channels on an external wall of the container, connecting an upper and lower header to respective upper and lower ends of the plurality of vertical channels, arranging a main distributing tubulation in the upper header, arranging at least one secondary distributing tubulation comprising thin vertical tubes inside the plurality of vertical channels, the thin vertical tubes having a length less than the length of the plurality of vertical channels to form an independently refrigeratable refrigeration zone, and feeding refrigerant liquid into the main tubulation and/or the into at least one secondary tubulation.

16. The process of claim 15, further comprising regulating and controlling the amount of refrigerant liquid flowing into the main distributing tubulation and the secondary distributing tubulation.

* * * * *